United States Patent [19]

Trezise et al.

[11] 4,448,556

[45] May 15, 1984

[54] CARTRIDGE FOR MATRIX PRINTER

[75] Inventors: Richard Trezise, San Jose; John Boldt, San Ramon; Keith Gnutzman, Alameda, all of Calif.

[73] Assignee: Chroma, San Jose, Calif.

[21] Appl. No.: 370,201

[22] Filed: Apr. 21, 1982

[51] Int. Cl.[3] ..... B41J 32/00

[52] U.S. Cl. ..... 400/208; 400/196

[58] Field of Search ..... 400/194–196.1, 400/208, 208.1; 242/199, 200

[56] References Cited

U.S. PATENT DOCUMENTS

| | | | |
|---|---|---|---|
| 3,311,316 | 3/1967 | Williams | 400/196 X |
| 3,386,676 | 6/1968 | Sotani et al. | 242/200 |
| 3,994,383 | 11/1976 | Best | 400/196.1 |
| 4,010,839 | 3/1977 | Guerrini et al. | 400/234 X |
| 4,252,450 | 2/1981 | Goodman et al. | 400/208 |
| 4,272,202 | 6/1981 | Schroeder et al. | 400/208 |
| 4,351,619 | 9/1982 | Duke et al. | 400/195 X |
| 4,367,502 | 1/1983 | Steger | 400/228 X |

OTHER PUBLICATIONS

*IBM Tech. Disc. Bulletin*, W. A. Abell et al., vol. 24, No. 12, May 1982, pp. 6520–6522.

*Primary Examiner*—Paul T. Sewell

*Attorney, Agent, or Firm*—Flehr, Hohbach, Test, Albritton & Herbert

[57] ABSTRACT

A ribbon cartridge for a matrix printer includes a capstan which is driven by an outboard gear accessible by a driver located on the printer from either the top or bottom. This allows cartridges to be closely stacked on a single carriage.

7 Claims, 6 Drawing Figures

CARTRIDGE FOR MATRIX PRINTER

This invention pertains to a cartridge containing a ribbon for use in a printer. The cartridge is particularly useful in high speed matrix printing, including color matrix printing. The ribbon may be an inked cloth or a film.

In one color matrix printer, as shown in copending application, Ser. No. 370,200, entitled COLOR PRINTER, and in the names of Richard Trezise, Keith Gnutzman and John Boldt, filed herewith and incorporated by reference, printout in selected colors and combinations of colors is achieved by employing a plurality of vertically stacked cartridges, each having a ribbon of a single color, instead of using a single cartridge employing, for example, four different bands of color. A lift mechanism in the printing machine positions the differently colored individual cartridges under control of a suitable program. Combinations of differently colored cartridges can be selected depending on application requirements. To minimize selection time between cartridges, they are closely stacked. An improved cartridge for use in such an arrangement has been provided.

Thus, in general, in accordance with the invention, there is provided a ribbon cartridge adapted to be employed with a printer. The cartridge includes an envelope having a predetermined thickness for storing ribbon and for supporting a length of ribbon for placement between a platen and print head. A capstan is driven within the envelope for moving the ribbon. An outboard gear is coupled to the ribbon driver means on the printer. The periphery of the gear engages the capstan to drive it; the gear being mounted for rotation on the ear portion of the envelope thinner than the predetermined thickness of the ribbon containing a portion of the envelope. The gear includes means engageable by the ribbon driver means of said printer.

In general, it is an object of the present invention to provide an improved ribbon cartridge for use in conjunction with a matrix printer, preferably a color matrix printer.

Figure 1:
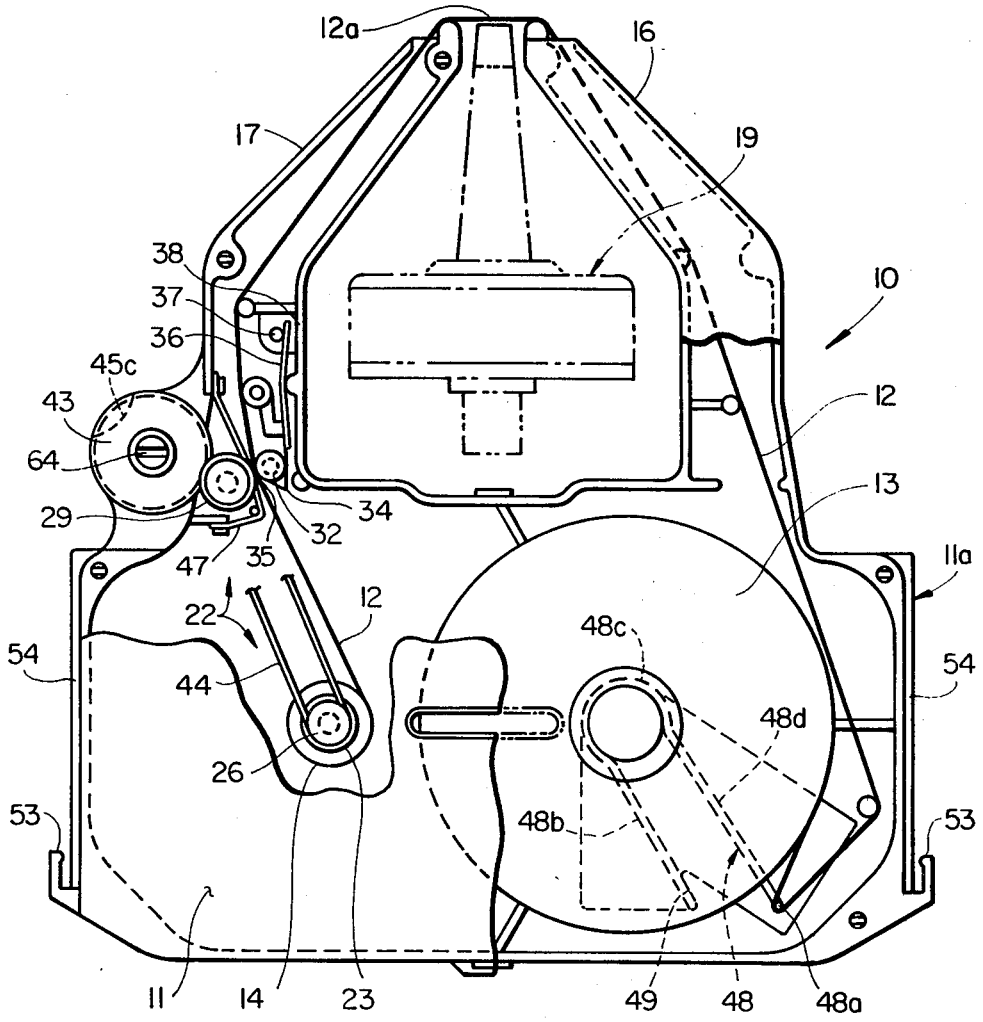
FIG. 1 shows a plan view of a ribbon cartridge according to the invention with portions of the cover broken away for clarity.

A ribbon cartridge 10 comprises a thin hollow envelope 11 having a main body portion 11*a* containing a length of inked ribbon 12 wrapped to form supply and take-up rolls 13, 14 respectively. Envelope 11 includes a pair of arms 16, 17 extending away from the main body portion 11*a*. Arms 16, 17 guide ribbon 12 out of and into envelope 11 and support a free length of ribbon 12*a* for placement between a matrix printing head assembly, diagrammatically represented at 19 and a platen (not shown). Arms 16, 17 accommodate head assembly 19 between them.

The supply roll of ribbon 13 includes a hub which is mounted for rotation within envelope 11. A rewind assembly 22 includes a take-up hub 23 also mounted for rotation on the back of envelope 11. It includes a sheave portion 26 formed on its upper end which extends, through an appropriate opening formed in envelope 11, outside of the envelope. The main portion of hub 23, however, remains within envelope 11 for wrapping ribbon 12 therearound to form take-up roll 14.

A capstan assembly 27 (see also FIG. 2) for feeding ribbon 12 to hub 23 includes a capstan 29 with a sheave portion 28 at its upper end disposed outside of envelope 11. Capstan 29 has axially spaced cylindrical body portions 29*a*, 29*b* defining a circular groove 31.

By engaging ribbon 12 along the edge margins thereof, the ribbon can be more easily engaged with a substantially common pressure along its edges so as to more reliably keep the ribbon within the nip 35 formed between an idler wheel 32 and capstan 29. Otherwise, ribbon 12 could move axially of capstan 29.

Idler wheel 32 is thus similarly shaped as capstan 29 and is releasably carried within a notch in an idler arm 34. The arm moves idler wheel into engagement with capstan body 29 to form a ribbon receiving nip 35 for feeding ribbon. Nip 35 is formed by the spaced portions of capstan 29 and idler wheel 32 to thus engage and drive the ribbon at its edges. A flat spring 36 captured at one end between a fixed post 37 and the wall 38 of the envelope urges idler 32 toward capstan 29.

Figure 2:
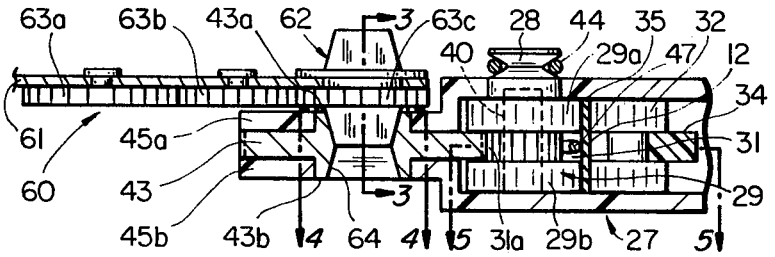
FIG. 2 shows an enlarged partial edge view with portions broken away of the cartridge of FIG. 1 along with ribbon drive means.

Means for driving capstan assembly 27 includes outboard gear 43 sandwiched and mounted for rotation between top and bottom housing portions 45*a*, 45*b* of a gear housing formed as an ear-like extension of envelope 11. As illustrated in FIG. 2, it is thinner than the ribbon containing portion of envelope 11. Gear 43 engages teeth 31*a* formed in groove 31 and extending around capstan 29.

Capstan body 29 includes a hollow interior for mounting the capstan onto a stationary mounting post 40 formed to protrude into envelope 11 from the back wall thereof. This provides for accurate alignment of the capstan when the cartridge is assembled. A drive belt 44 trained about sheaves 26 and 28 rotates take-up hub 23 in response to rotation of capstan 29. The belt slips on the sheaves to accommodate different rewind roll diameters.

Figure 3:
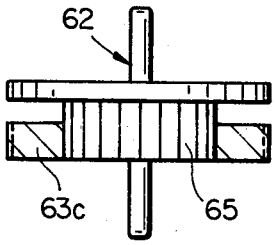
FIG. 3 is a side view of a splined gear of FIG. 2.

Since gear 43 is intermediate the cartridge width and thinner and extends beyond the main body, it can be easily engaged from either side of the cartridge. FIG. 2 also illustrates ribbon driver means 60 from an associated printer which includes a pivoted arm 61, a two-ended splined shaft 62 (see FIG. 3 also) rotatable in the end of the arm, and driven by a gear arrangement 63. Such arrangement includes a drive gear 63*a*, an idler gear 63*b* and a gear 63*c* which is pressed on a knurled disc portion 65 of shaft 62. Shaft 62 engages the slot-like splined hub 64 (see FIG. 1 also) of gear 43, to drive it. This may be done from the top as shown in FIG. 2 or from the bottom side. By making gear 43 and its ear-like mounting thinner than envelope 11, driver 60 may easily be moved between two stacked or closely spaced cartridges and selectively drive either.

Figure 4A:
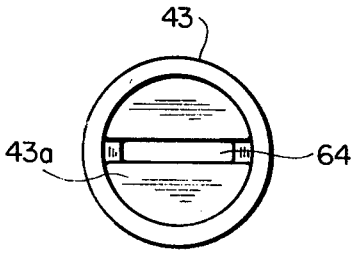
FIG. 4A is a plan view taken along line 4—4 of a hub portion of FIG. 2.
Figure 4B:
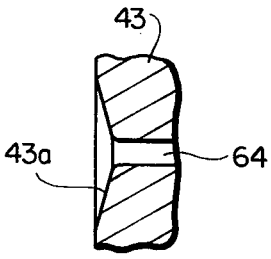
FIG. 4B is a diagram showing the slope of the surfaces of FIG. 4A.

To facilitate engagement of shaft 62 with hub 64, the opposed surfaces 43*a*, 43*b* of gear 43, which are adjacent hub 64, are ramped or sloped downwardly in adjacent pairs (see FIG. 4A and its detail FIG. 4B) to allow the flattened ends of shaft 62 to automatically run into hub 64 after initial contact is made. In effect, these surfaces serve as cams.

In some circumstances, it may be possible to alternatively drive gear 43 at its edge and still accomplish the above objectives. In any case, the housing for the gear has a cutout 45*c* to expose an edge of the gear which may be manually rotated by a finger. This might be necessary during installation if free length 12*a* is loose.

Figure 5:
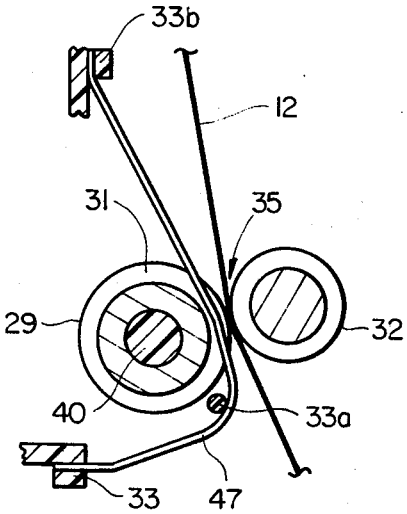
FIG. 5 is an enlarged cross-section taken along line 5—5 of FIG. 2.

As best illustrated in FIG. 5, means for deflecting ribbon 12 as it passes through nip 35 for preventing ribbon 12 from jamming or wrapping about the body of capstan 29 includes the wire deflector element 47 extending between idler 32 and capstan 29 as permitted by groove 31. Wire 47 is held in place by hold-downs 33 and 33*a* which are part of housing 11 and by a groove 33*b* in the housing (see FIG. 1 also). Wire 47 may be round or rectangular if space is limited.

Means for applying a limited tension to ribbon 12 includes the U-shaped spring 48 carried about hub 21 (FIG. 1) and formed with a free end 48*a* extending generally parallel to the axis of rotation of supply roll 13.

Spring 48 includes a tension leg 48*d*, a fixed holding or stopping leg 48*b* and a clamping or gripping portion 48*c* therebetween clipped about hub 21.

Spring 48 functions as a means for tensioning ribbon 12. Thus, with ribbon 12 trained about direction changing end 48*a*, a loop is formed tending to rotate spring 48 clockwise as the ribbon is drawn from roll 13. The foregoing action tends to reduce tension on ribbon 12 since the outer end of arm 48*b* of spring 48 engages a fixed stop 49 to prevent counterclockwise rotation of spring 48. Thus, the portion 48*c* of spring 48 will tend to release its grip upon hub 21 to achieve a proper tension in ribbon 12.

The cartridge housing includes retaining fingers 53 which engage the cartridge housing (see copending application) to retain the cartridge. The side of the cartridge includes ribs 54 which engage grooves in the housing to guide the cartridge as it is inserted in the housing.

If fan-folded ribbon is to be used in envelope 11, thereby eliminating use of rolls of ribbon, means for tensioning the ribbon would be included within arm 16.

Thus, an improved ribbon cartridge has been provided which is especially useful in a multi-color stacked arrangement.

We claim:

1. A ribbon cartridge for use in a printer comprising:

an envelope having a predetermined thickness for storing ribbon and for supporting a length of ribbon for placement between a platen and print head;

a capstan driven within the envelope for moving the ribbon;

an outboard gear for coupling to ribbon driver means on the printer, the periphery of the gear engaging the capstan to drive it, the gear being mounted for rotation on an ear portion of the envelope thinner than the predetermined thickness of the ribbon containing portion of envelope, said gear including means engageable by said ribbon driver means of said printer.

2. A ribbon cartridge for use in a printer comprising:

an envelope having a predetermined thickness for storing ribbon and for supporting a length of ribbon for placement between a platen and print head;

a capstan driven within the envelope for moving the ribbon;

an outboard gear for coupling to ribbon driver means on the printer, the periphery of the gear engaging the capstan to drive it, the gear being mounted for rotation on an ear portion of the envelope thinner than the predetermined thickness of the ribbon containing portion of envelope, the rotational axis containing a splined hub on both sides for engagement by said ribbon driver means of said printer.

3. A ribbon cartridge for use in a printer as in claim 1 where said capstan has a circular groove for accommodating a wire form to prevent jamming of ribbon.

4. A ribbon cartridge for use in a printer as in claim 3 where said circular groove meshes with said periphery of said outboard gear.

5. A ribbon cartridge as in claim 2 where said outboard gear includes an exposed edge for manual rotation.

6. A ribbon cartridge as in claim 2 where said outboard gear includes a ramped surface adjacent said splined hub for facilitating said engagement by said ribbon driver means.

7. A ribbon cartridge as in claim 6 where said splined hub is slot shaped.

* * * * *